US006022261A

United States Patent [19]

Zhu et al.

[11] Patent Number: 6,022,261

[45] Date of Patent: Feb. 8, 2000

[54] VERTICALLY SINKABLE TOY SHIP MODEL

[76] Inventors: Christopher Ren Zhu; Sheng Bo Zhu, both of 1072 Minoru Dr., San Jose, Calif. 95120

[21] Appl. No.: 09/075,555

[22] Filed: May 8, 1998

[51] Int. Cl.[7] ..... A63H 23/02

[52] U.S. Cl. ..... 446/161

[58] Field of Search ..... 446/157, 154, 446/156, 160, 161

[56] References Cited

U.S. PATENT DOCUMENTS

| | | | |
|---|---|---|---|
| 1,205,759 | 11/1916 | Lewis | 446/161 |
| 2,708,810 | 5/1955 | Canto et al. | 446/161 |
| 3,451,159 | 6/1969 | Springfors | 446/161 |
| 3,695,607 | 10/1972 | Stouffer | 446/161 |

FOREIGN PATENT DOCUMENTS

| | | | |
|---|---|---|---|
| 304023 | 1/1937 | Italy | 446/160 |
| 701358 | 12/1953 | United Kingdom | 446/161 |
| 2133998 | 8/1984 | United Kingdom | 446/161 |

*Primary Examiner*—D Neal Muir

*Attorney, Agent, or Firm*—Pacific Law Group LLP; Chi Ping Chang

[57] ABSTRACT

The present invention relates to a vertically sinkable toy ship model comprising a plurality of compartments having a plurality of correspondent holes to provide fluid communication between the compartments. When the toy ship model is set for sinking, water enters into the first compartment of the hull through an adjustable opening to cause the ship model to tilt forward to initiate sinking with the aid of a weight until the water level reaches the first wall hole between the first compartment and the second compartment whereby the water will then flow from the first compartment into the second compartment via the first compartment wall hole to cause the sinking ship to rise into a vertically standing position in the water; the water will likewise proceed to fill the last compartment, at which point the water will fills the entire hull to cause the sinking ship to submerge under water.

2 Claims, 3 Drawing Sheets

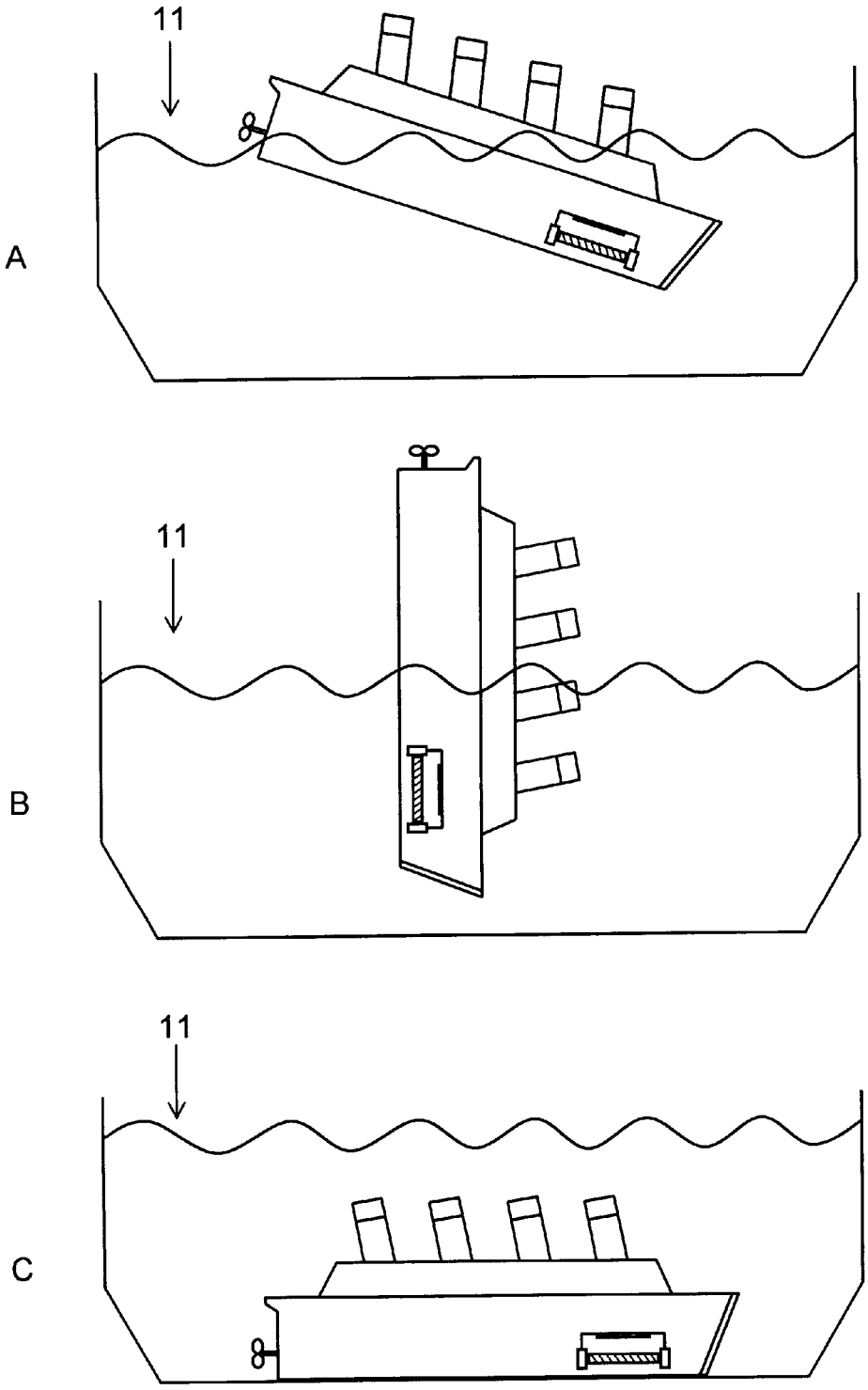
Fig. 3A-C

VERTICALLY SINKABLE TOY SHIP MODEL

BACKGROUND OF THE INVENTION

1. Field of the Invention

The present invention encompasses a scaled down sinkable toy ship model. More specifically, it relates to a scaled down sinkable toy ship model of the White Star Line R.M.S. Titanic, the world famous cruise ship which tragically sank on Apr. 15, 1912. This invention is targeted at both children and adults alike for historical remembrance, collecting and entertainment purposes.

2. Description of the Prior Art

Within the toy model industry today, there are two types of model ships for purchase. There are those which are constructed from model kits and those that come fully-assembled. Regardless, these models are generally display pieces for show only. While these ships are pleasing to gaze upon, they lack the main functional attribute of ships, being able to float in water. Moreover, the historical significance of the Titanic, where the ship that tragically sank after hitting an iceberg, is not evident in current Titanic ship models because the models never leave their tabletop display stands or cases. Finally, to Applicant's knowledge, no attempt has been made to create a vertically sinkable toy replica of the Titanic ship for children to play with.

As such, it is a primary object of the present invention to provide a working model of the Titanic which floats on water.

It is an additional object of the present invention for the model to have the ability to actually sink like the real Titanic, which sank in the Atlantic Ocean after hitting an iceberg.

It is yet an additional object of the present invention for the model to duplicate precisely the sinking of the Titanic, whereby the bow of the ship was the first to sink and the rest of the ship followed thereafter, with the hull rising to a completely vertical state before the ship finally plunged into the ocean.

SUMMARY OF THE INVENTION

The present invention shall consist of a replica model of the Titanic which will float on the surface of a body of water and has the ability to sink in the same manner as the real Titanic.

In operation, the model ship will be stay afloat by not allowing any water to flow into the ship's internal hull compartments. Furthermore, the hull design of the model ship will allow it to remain afloat on top of the surface of the water.

The hull will have an adjustable opening near the bow end of the ship. Such opening shall have a slip door which may be manually opened and closed. When the slip door on the opening is opened, water shall enter into the hull, thereby causing the model ship to start to sink. The rate at which the ship sinks can be controlled by adjusting the size of the opening via the slip door. The hull is divided into three separate, lengthwise intersected compartments, each taking up a third of the total hull space. As the water enters into the bow compartment, the bow of the ship shall start to sink. The water will then enter into the second compartment until it is nearly full, thereby causing the middle of the ship to sink and the stern end of the ship to raise vertically into the air and the ship to stand up straight up in the water. Finally, as the water flows into the stern compartment, the entire ship will sink vertically into the water.

BRIEF DESCRIPTION OF THE DRAWINGS

The following drawings, when utilized in tandem with the detailed description of the invention below, shall help to further detail the operation and mechanism of the present invention:

FIG. 3 is a schematic representation of the present invention, which depicts the sinking action of the Titanic model.

DETAILED DESCRIPTION OF THE INVENTION

The present invention provides a floating model of the R.M.S. Titanic ship which has the ability to sink in the same manner as the original Titanic ship, whereby the bow of the ship sank first and the rest of the ship rose vertically in the water, effectively standing up straight, before eventually sinking straight down into the water.

Figure 1:
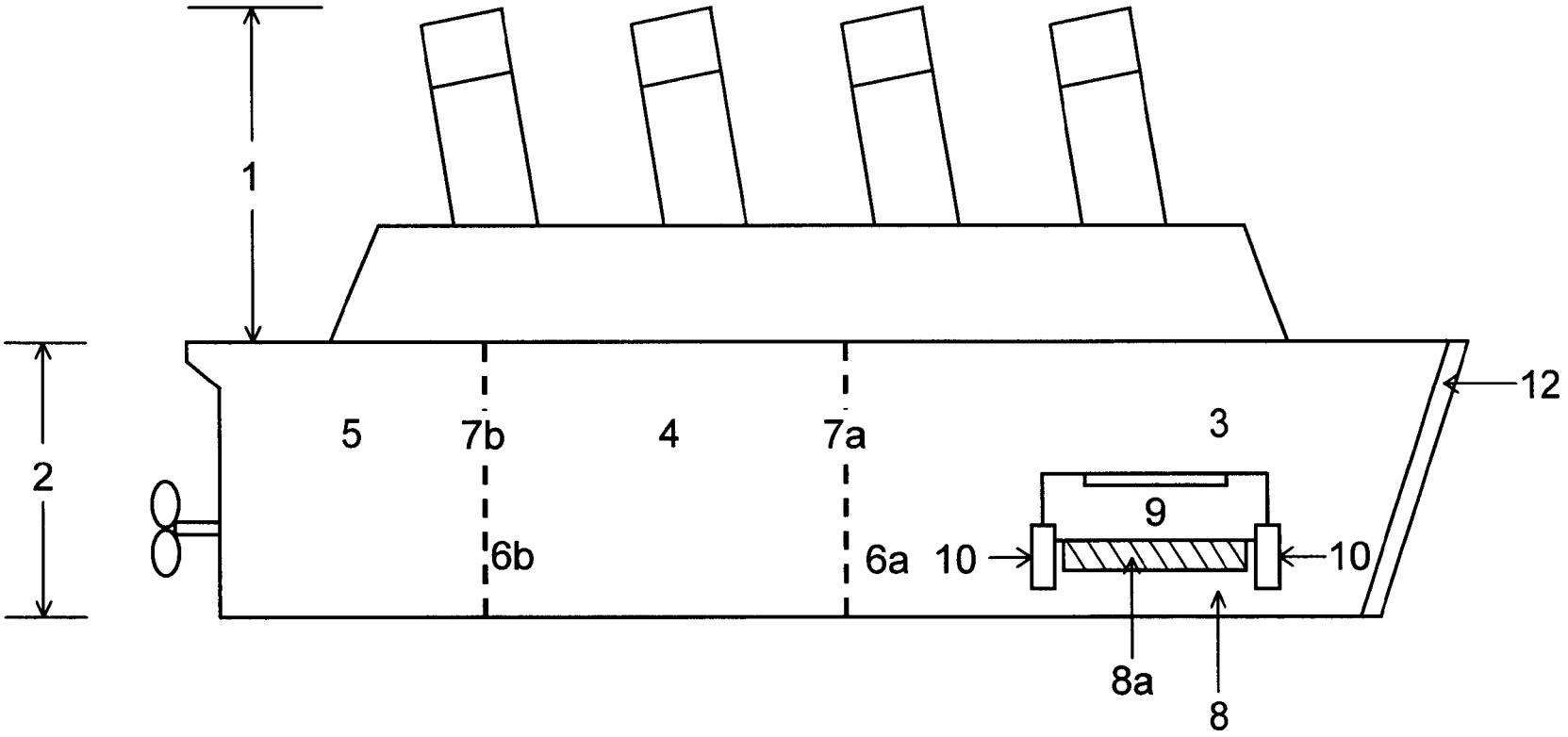
FIG. 1 is a schematic representation of the present invention, which depicts the interior compartment walls as well as the slip door opening in the bow.
Figure 2:
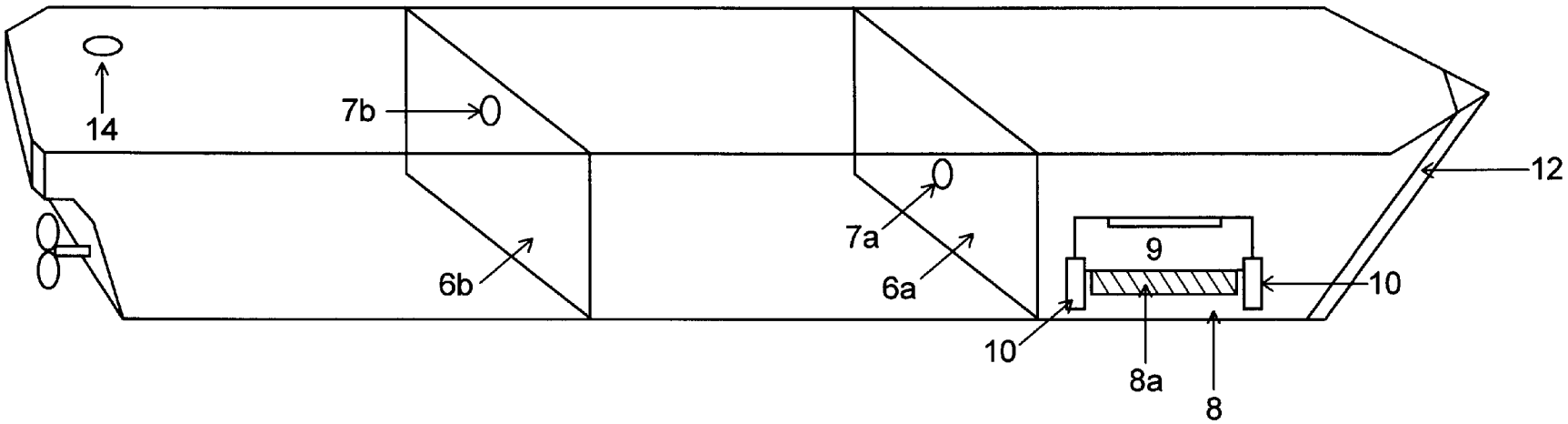
FIG. 2 is a schematic representation of the present invention, which depicts the placement of the compartment holes in the compartment walls as well as the slip door opening in the bow.

Illustrated in FIG. 1 is the side view of the ship, whereby the ship can be described as dividing into two main areas: the passenger and smokestack area 1 and the hull 2 of the ship. The passenger and smokestack area 1 have no function other than to depict the top half of the actual Titanic ship or any other ship alike. The hull 2 is constructed so that it can remain watertight, thus allowing no water to enter. This ensures the ship will float when placed in water. The hull 2 is divided into three separate hollow compartments, namely, bow compartment 3, middle compartment 4 and stern compartment 5, which intersect the ship crosswise. The compartments are separated by vertical compartment walls 6*a*, 6*b*, as depicted in FIG. 1 and FIG. 2. Interconnecting the compartments are holes 7*a*, 7*b* in the compartment walls where water can flow, as illustrated in FIG. 1 and FIG. 2. The number of compartments is not limited to three as described above. More compartments may be added as desired to provide for more gradual sinking.

As shown in FIG. 1 and FIG. 2, an opening 8 is built into the bow compartment 3 of the hull 2 to allow water to enter. Such opening 8 contains a leak slip 8*a* and a slip door 9 which may be manually opened and closed. When the slip door 9 on the opening 8 is opened, an air stream is created within the hull 2 between the opening 8 and a vent hole 14 which is located on a top side of the hull 2 in a position relative to that of the stern compartment 5. As a result of the air stream, water begins to enter into the hull 2. The slip door 9 can be manually adjusted to control the rate of flow of water into the hull 2. The slip door 9 operates by sliding up and down along two tracks 10 alongside the opening 8. When the slip door 9 is closed, no water can enter. When the slip door 9 is partially opened, water will flow slowly into the hull through the leak slip 8*a*. Conversely, when the slip door 9 is fully opened, water will flow at a faster rate into the hull 2.

In operation, when the slip door 9 is opened, water flows into the bow compartment 3 until the water level reaches the wall hole 7*a* between the bow compartment 3 and middle compartment 4. As the bow compartment 3 fills with water, the bow end of the ship will become heavy with the weight of the water and begin to sink under the surface of the water 11 and the ship will tilt forward as illustrated in FIG. 3A. The sinking and tilting action will be further facilitated by the placement of a weight 12 in the bow of the ship as shown in FIG. 1 and FIG. 2. The amount of weight put in the bow will vary according to the materials used to construct the rest of the ship. Back inside the hull 2, the water will then flow from the bow compartment 3 into the middle compartment 4 via the compartment wall hole 7*a*. As the water fills the middle compartment 4, the weight of the water-filled bow end will be weighed down by gravity and will cause the sinking ship to rise into a vertical position, effectively standing the sinking ship straight up in the water, as shown in FIG. 3B.

Back inside the hull 2 in FIG. 1, the water will proceed to fill up the middle compartment 4 until the water level reaches the compartment wall hole 7*b* between the middle 4 and stern 5 compartments. By this time, the ship will have sunken vertically down some more. As the water leaks into the stern compartment 5, the ship will continue to sink. When the water level completely fills the stern compartment 5, the water will exit the hull 2 and join with the body of water the ship is in through the vent hole 14 as depicted in FIG. 2. The entire ship, with all of its hull compartments 3, 4, 5 filled with water, will then submerge under the water surface as shown in FIG. 3C, in the same manner as the original Titanic on Apr. 15, 1912.

It should be understood that the above description of the Titanic is used merely as an example in the present invention. The vertically sinkable model ship design can be applied to any model ship, in addition to the Titanic.

Although the preferred embodiment of the invention has been disclosed for illustrative purposes, those skilled in the art will appreciate that various modifications, additions and substitutions are possible, without departing from the scope and spirit of the invention, as disclosed in the accompanying claims.

We claim:

1. A sinkable toy ship model which comprises:

a passenger and smokestack area;

a hull, said hull is being divided into a plurality of compartments by a plurality of correspondent compartment walls vertically intersecting the hull crosswise wherein the compartment walls further have a plurality of correspondent holes to provide fluid communication between said compartments when the sinkable toy ship model is set for sinking;

an adjustable opening built near a bottom side of the first compartment to allow water to enter the hull when said adjustable opening is opened; wherein said adjustable opening further comprises a leak slip and a slip door slidably mounted to two tracks alongside said adjustable opening through which said adjustable opening is manually adjusted to control the rate of flow of water into the hull;

a vent hole located on a top side of the hull in a position relative to that of the last compartment of said plurality of compartments to aid the water entry to the hull;

a weight is placed on a front edge of the first compartment opposite to the correspondent first compartment wall to facilitate the sinking; and wherein when the adjustable opening is opened, water enters into the first compartment of the hull, as a result of an air stream created within the hull between the opening and the vent hole, to cause the ship model to tilt forward to initiate sinking with the aid of the weight until the water level reaches the first wall hole between the first compartment and the second compartment whereby the water will then flow from the first compartment into the second compartment via the first compartment wall hole to cause the sinking ship to rise into a vertically standing position in the water; the water will proceed to fill the second compartment until the water level reaches the second wall hole between the second compartment and the subsequent compartment whereby the water will then flow from the second compartment into the subsequent compartment via the second compartment wall hole to cause the sinking ship to remain in the vertically standing position until the water level completely fills the last compartment of said plurality of compartments, at which point the water will fill the entire hull to cause the sinking ship to submerge under water.

2. A sinkable toy ship model which comprises:

a hull, said hull is being divided into a plurality of compartments by a plurality of correspondent compartment walls vertically intersecting the hull crosswise wherein the compartment walls further have a plurality of correspondent holes to provide fluid communication between said compartments when the sinkable toy ship model is set for sinking;

an adjustable opening built near a bottom side of the first compartment to allow water to enter the hull when said adjustable opening is opened; wherein said adjustable opening further comprises a leak slip and a slip door slidably mounted to two tracks alongside said adjustable opening through which said adjustable opening is manually adjusted to control the rate of flow of water into the hull;

a vent hole located on a top side of the hull in a position relative to that of the last compartment of said plurality of compartments to aid the water entry to the hull;

a weight is placed on a front edge of the first compartment opposite to the correspondent first compartment wall to facilitate the sinking; and wherein when the adjustable opening is opened, water enters into the first compartment of the hull, as a result of an air stream created within the hull between the opening and the vent hole, to cause the ship model to tilt forward to initiate sinking with the aid of the weight until the water level reaches the first wall hole between the first compartment and the second compartment whereby the water will then flow from the first compartment into the second compartment via the first compartment wall hole to cause the sinking ship to rise into a vertically standing position in the water; the water will proceed to fill the second compartment until the water level reaches the second wall hole between the second compartment and the subsequent compartment whereby the water will then flow from the second compartment into the subsequent compartment via the second compartment wall hole to cause the sinking ship to remain in the vertically standing position until the water level completely fills the last compartment of said plurality of compartments, at which point the water will fill the entire hull to cause the sinking ship to submerge under water.

* * * * *